United States Patent [19]

Stansbury

[11] 4,084,536

[45] Apr. 18, 1978

[54] SAFETY CONTROL SYSTEM FOR HYDRAULIC JET TURBINES

[76] Inventor: Thomas A. Stansbury, 7237 S. Shore Dr., Chicago, Ill. 60649

[21] Appl. No.: 413,685

[22] Filed: Nov. 7, 1973

[51] Int. Cl.[2] ..... B63H 11/02

[52] U.S. Cl. ..... 115/16; 115/11; 123/98; 123/179 K

[58] Field of Search ..... 115/11, 14, 12 R, 16; 114/151; 123/179 K, 98; 335/205

[56] References Cited

U.S. PATENT DOCUMENTS

| | | | |
|---|---|---|---|
| 2,638,862 | 5/1953 | Long | 123/98 |
| 2,705,485 | 4/1955 | Morse | 123/179 K |
| 3,185,124 | 5/1965 | Spence | 115/12 R |
| 3,284,743 | 11/1966 | Spewock et al. | 335/205 |

*Primary Examiner*—Trygve M. Blix
*Assistant Examiner*—Sherman D. Basinger

[57] ABSTRACT

A safety control system for the prevention of undesired reactive thrust which may be produced from hydraulic jet turbines includes manually operated controls connected to the shutoff valve of a hydraulic jet venturi section and a switch operatively connected to the shutoff valve. This switch is closed when the shutoff valve closes the main propulsion opening. It is connected in series with the starter of the engine driving the jet turbine so that the engine can only be started when the main propulsion opening is closed. Further, controls are provided between the throttle of the engine and the shutoff valve controls to reduce the rotational driveshaft speed when the shutoff valve is closed.

3 Claims, 3 Drawing Figures

SAFETY CONTROL SYSTEM FOR HYDRAULIC JET TURBINES

The present invention relates to a safety control system for vessels propelled by hydraulic jet turbines and more particularly to safety control systems for the prevention of undesired reactive thrust being produced from hydraulic jet turbines.

Hydraulic jet turbines have been manufactured in quantity for use in pleasure boats. Generally, these hydraulic jet turbines have had a main propulsion opening in a venturi section of such a turbine for ejecting water into the atmosphere. This exerts thrust on a vessel. Usually a gate is mounted on the turbine which may be swung into the path of the ejected water to create a reverse flow and therefore a reverse thrust. These hydraulic jet turbines exerted either a forward or a reverse thrust on the vessel in which they were mounted whenever the engine driving the turbine was in operation. Therefore, such vessels were always either in forward or reverse movement. When operating normally, the practice has been to start the engines at an idle throttle setting and to utilize the idle throttle setting for a minimum amount of thrust at those times when it was desired to approach a stop with the vessel. However when an engine becomes difficult to start the operator frequently opens the throttle in an effort to start it. If the engine does start, a high thrust is then placed on the vessel which may result in injuries to persons aboard the vessel by being thrown to the deck or into the structure. On smaller boats the vessel may be driven into persons in the water. In addition to advancing the throttle on an engine which is difficult to start, frequently an operator will inadvertently start the engine with the throttle in an advance position by failing to observe the position of the throttle before attempting to start the engine. This of course results in the aforementioned type of accidents.

In my co-pending application Ser. No. 252,901, filed May 12, 1972, now U.S. Pat. No. 3,854,437 issued Dec. 17, 1974, for a Hydraulic Jet Stern Steering Control, there is disclosed in FIGS. 1–5 thereof a hydraulic jet turbine unit which incorporates a positive neutral. A shutoff valve 44 completely stops the flow of water from being ejected through the main propulsion nozzle of the turbine so that the flow turbulently circles back to the turbine blades. In FIGS. 6–9 thereof there is disclosed a hydraulic turbine unit wherein a portion of the flow of water may be reversed to counteract the thrust of the portion of the flow of water which is not reversed by the clam shell 109. FIGS. 10–14 of the co-pending application illustrates another form of hydraulic turbine wherein the control means diverts a portion of the flow being ejected through the nozzle so that the split flow results in negative thrust of the vessel. FIG. 15 of the aforementioned patent shows another form of hydraulic jet turbine wherein there is provided a positive neutral by a complete shutoff of the water which would otherwise be ejected through the main propulsion nozzle of the turbine. Thus the four forms of hydraulic jet units shown in my co-pending application have a positive neutral control position at which no thrust is produced on a vessel. However to utilize these neutral positions when starting the engine which drives the turbine, the operator must remember to place the turbine control system in that neutral position. The present invention provides a safety control system wherein an engine driving any one of the four types of hydraulic jet turbines of the types described in my co-pending application cannot be started by an operator unless the turbine control system is in the respective positive neutral control position. Thus even if a throttle is advanced at the time of starting the driving engine the resultant thrust on the vessel will either be nonexistent or negligible to prevent personal injuries of the type previously described.

It is therefore an object of the present invention to provide a new and improved hydraulic jet turbine system.

A further object is to provide a safety control system for controlling both a hydraulic jet turbine and its driving engine wherein the engine cannot be started unless the controlled mechanisms of the turbine are in a neutral position to prevent any thrust being applied to a vessel regardless of the throttle setting of the engine.

Further objects and advantages will become apparent from the following detailed description taken in conjunction with accompanying drawings in which.

Figure 1:
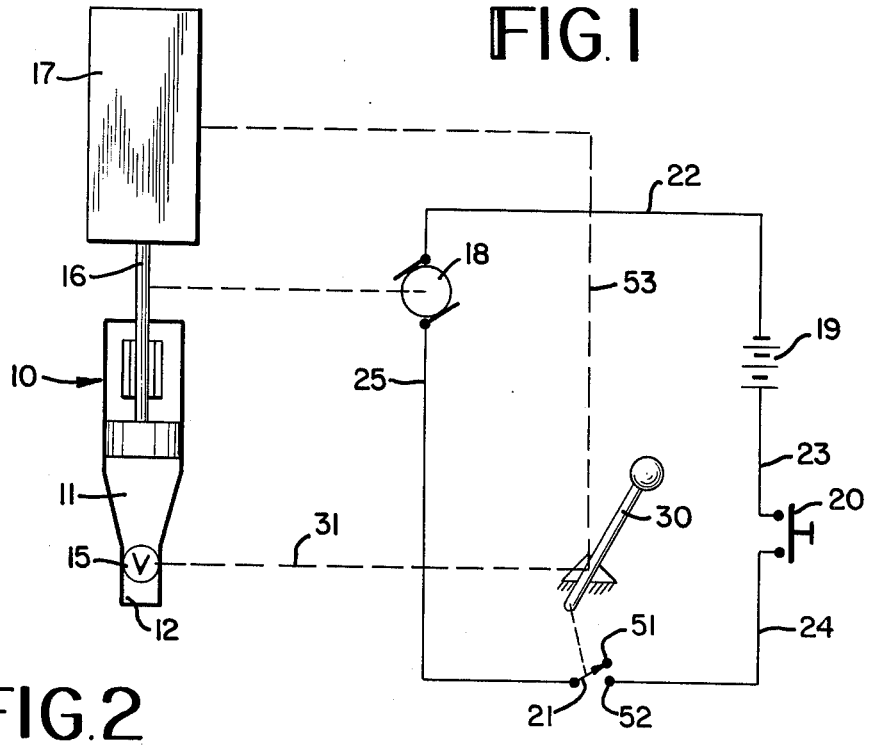
FIG. 1 is a schematic diagram of a preferred embodiment of the invention.

While this invention is susceptible of embodiment in many different forms, there is shown in the drawings and will herein be described in further detail, embodiments of the invention with the understanding that the present disclosures are to be considered as exemplifications of the principles of the invention and are not intended to limit the invention to the embodiments herein described. The scope of the invention will be pointed out in the appended claims.

Referring now to FIG. 1 a hydraulic jet turbine 10 has a venturi section 11 and a main propulsion opening 12. A positive shutoff device 15 is mounted in conjunction with the main propulsion opening 12. The turbine may be of any of the four types illustrated in my aforementioned co-pending application Ser. No. 252,901. The turbine 10 is connected by a shaft 16 to an engine 17 to be driven thereby. The driveshaft 16 of the engine 17 is coupled to an engine starter 18 in any suitable manner well known to those skilled in the art.

The engine starter 18 is connected in series with a source of electrical power such as a battery 19, a starter switch 20 and a magnetic electrical switch 21 by electrical leads 22–25. A lever control device 30 is connected to the positive neutral device 15 by a control cable 31 and to switch 21 in the manner illustrated in FIG. 2.

Figure 2:
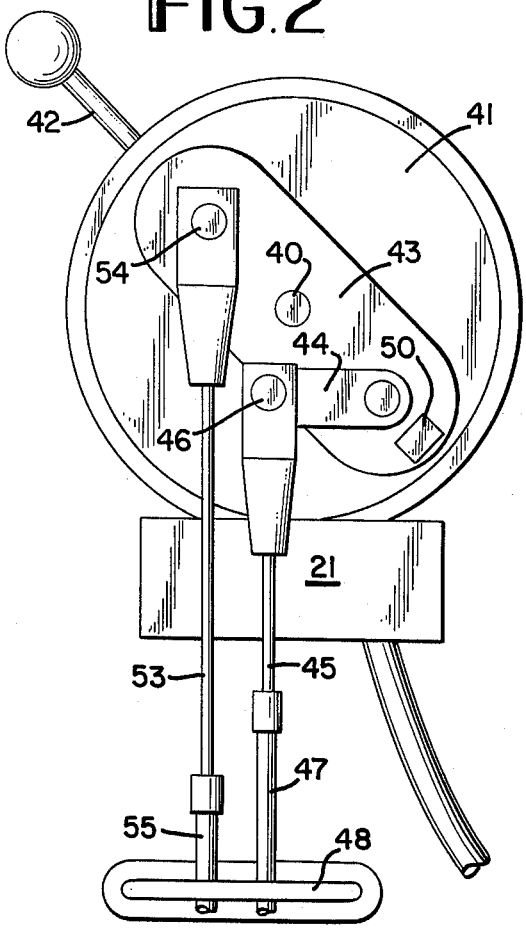
FIG. 2 is an elevational side view of a portion of the embodiment of the invention illustrated in FIG. 1.

Referring to FIG. 2 a manually operated control is illustrated of the type such as a Morse Control model MH-2 which is suitable for the control device 30. A shaft 40 is rotatively mounted in a mounting plate 41. A lever arm 42 is rigidly secured to one end of the shaft and a cam plate 43 is secured to the other end of the shaft 40. A lever arm 44 is rigidly mounted on the cam plate 43 and is connected to a control cable 45 by a connecting post 46. The cable 45 slides longitudinally through a cable housing 47. A clamp 48 secures the housing 47 to the structure of a vessel (not shown). The mounting plate 41 is also secured to the structure of the vessel, so that movement of the lever 42 imparts longitudinal motion to the cable 45. If the turbine is of the positive shutoff valve type illustrated in FIGS. 1–3 of my co-pending application the cable 45 is the same as the cable 52 which positions the shutoff valve 44 in either the forward, neutral or reverse positions. With the handle 42 in the vertical position the valve 44 shown in my co-pending application would be closed. Movement to the right of handle 42 places the shutoff valve 44 in a forward position and movement to the left would place the valve 44 in a reverse position. Similarly if the turbine illustrated in FIGS. 6–9 of my co-pending application is utilized as the turbine 10, the control cable 45 would be the same as control cable 127 which positions the plate 109. With this turbine the plate 109 would be in its intermediate neutral position which provides the forward and reverse thrust of the water being issued from the main propulsion opening. Movement of the lever 42 would raise the plate 109 to the forward control position and movement of the arm 42 to the left would bring the plate 109 fully down as illustrated in FIG. 7 of my co-pending application to provide reverse. As the handle 42 is returned to a vertical position, a magnet 50 mounted on the lower end of the cam plate 43 attracts an arm in the magnetic switch 21 to force a contact 51 to close with a cooperating electrical contact 52. Whenever the lever arm 42 is removed from the area of the vertical position the magnet 50 is moved away from switch 21 and the contacts 51 and 52 open the starting circuit to the starter 18 as illustrated in FIG. 1. Thus the engine 17 can only be started when the manually operated lever 42 is in its "neutral" position. Even if the throttle of the engine 17 is advanced when the engine is started, there will be no thrust if the turbine of the type illustrated in FIGS. 1–5 of my co-pending application is utilized as the turbine 10, or there will be negligible thrust if a turbine of the type illustrated in FIGS. 6–9 is utilized. Referring to FIG. 2 a control cable 53 is connected to the cam plate 43 by a connecting post 54. The cable 53 slides longitudinally in a cable housing 55 which is secured to the structure of the vessel by the clamp 48. The cable 53 is connected to the throttle of the engine 17 to control the thrust being provided by the turbine 10. When the handle 42 is in a vertical position, the throttle is retarded to an idle position. Thus the lever 30 controls both the closure of the ignition of the starter circuit except for the manually operated starter switch 20 and the throttle of the engine 17.

Figure 3:
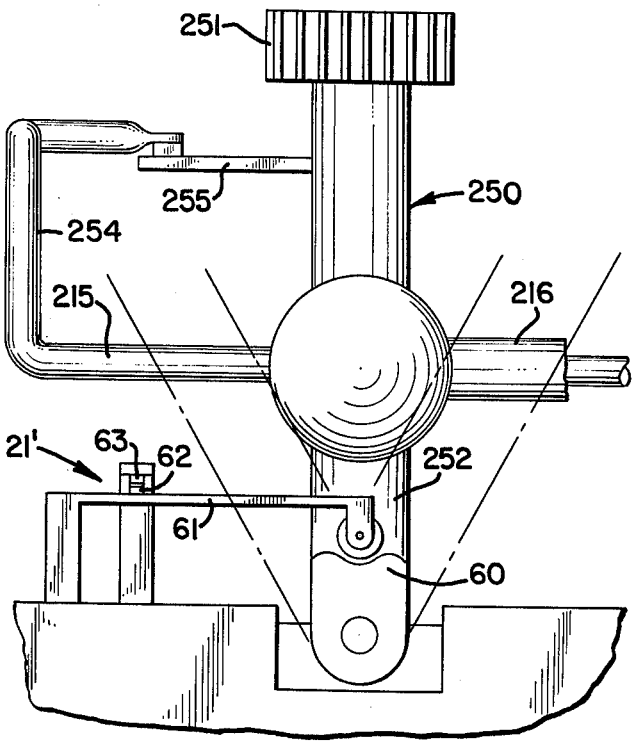
FIG. 3 is an elevational view of a portion of a modified version of the embodiment of the invention illustrated in FIGS. 1 and 2.

FIG. 3 illustrates a modified form of the control device 30 for the two types of hydraulic jet turbine illustrated in FIGS. 10–14 and 15 respectively of my aforementioned co-pending application. The ball throttle control in each case has a forward, neutral and reverse position. The cam plate 60 is connected to the lever 252. The corresponding elements illustrated in FIG. 14 of the co-pending application and in FIG. 3 of this disclosure have been given the same identifying numbers. A contact resilient lever arm 61 is contacted by the cam plate 60 when the lever 252 is in a vertical position to close contacts 62 and 63. Thus the cam plate 60, arm 61 and the contacts 62 and 63 constitute a switch 21 which performs the same function as the switch 21 in FIG. 1 with the exception that there is no connection to the throttle and the throttle must be placed on a separate control (not shown).

Those skilled in the art will understand that a separate control may be utilized for the throttle for the engine 17 and a similar cam operated switch may be mounted with that throttle and connected in series with the switches 20 and 21 so that not only must the turbine be in a neutral position but the throttle must also be in an idle position regardless of whether the combined single lever control illustrated in FIG. 2 is utilized or a separate throttle control is utilized.

I claim:

1. A hydraulic jet propulsion system for a vessel comprising, a hydraulic jet turbine mounted in a vessel having a venturi section and a main propulsion opening in said venturi section through which water is ejected into the atmosphere, a shutoff valve closing said main propulsion opening, manually operated control means operatively connected to said shutoff valve to close and open said valve, an engine having a drive shaft connected to said hydraulic jet turbine to drive said turbine, said engine having an electrically energized starter, a manually operated switch electrically connected in series with said starter, a switch operatively connected to said manually operated control means to be closed when said shutoff valve is closing said main propulsion opening and electrically connected in series with said starter and said manually operated switch, said control means operated switch comprising a magnet and a magnetic electrical switch, and a source of electrical power connected in series with said starter, said manually operated switch and control means operated switch.

2. A hydraulic jet propulsion system for a vessel comprising, a hydraulic jet turbine mounted in a vessel having a venturi section and a main propulsion opening in said venturi section through which water is ejected into the atmosphere, a shutoff valve closing said main propulsion opening, manually operated control means operatively connected to said shutoff valve to close and open said valve, an engine having a drive shaft connected to said hydraulic jet turbine to drive said turbine, said engine having an electrically energized starter, a manually operated switch electrically connected in series with said starter, a switch operatively connected to said manually operated control means to be closed when said shutoff valve is closing said main propulsion opening and electrically connected in series with said starter and said manually operated switch, a source of electrical power connected in series with said starter, said manually operated switch and control means operated switch, a throttle operatively connected to said engine to control the rotational drive shaft speed of said engine, and means operatively connecting said throttle and said manually operated shutoff valve control means to reduce the rotational drive shaft speed when said shutoff valve is closed.

3. A hydraulic jet propulsion system for a vessel comprising, a hydraulic jet turbine mounted in a vessel having a venturi section and a main propulsion opening in said venturi section through which water is ejected into the atmosphere, means for neutralizing forward and reverse thrust mounted at said main propulsion opening, manually operated control means operatively connected to said means for neutralizing thrust to selectively provide forward thrust, reverse thrust or negligible thrust, an engine having a drive shaft connected to said hydraulic jet turbine to drive said turbine, said engine having an electrically energized starter, a manually operated switch electrically connected in series with said starter, a switch operatively connected to said manually operated control means to be closed when said means for neutralizing thrust is operating to produce negligible thrust from said turbine and electrically connected in series with said starter and said manually operated switch, a source of electrical power connected in series with said starter, said manually operated switch and said control means operated switch, a throttle operatively connected to said engine to control rotational drive shaft speed of said engine, and means operatively connecting said throttle and said means for neutralizing thrust to reduce the rotational drive shaft speed when said means for neutralizing thrust is operating to produce negligible thrust from said turbine.

* * * * *